US006233827B1

(12) United States Patent
Oliver et al.

(10) Patent No.: US 6,233,827 B1
(45) Date of Patent: May 22, 2001

(54) METHOD FOR ENHANCING A FORKLIFT CAPACITY

(75) Inventors: Raymond D. Oliver, Columbiaville; Vic Moody, Yale, both of MI (US)

(73) Assignee: Bristol Manufacturing, Inc., Davison, MI (US)

( * ) Notice: Subject to any disclaimer, the term of this patent is extended or adjusted under 35 U.S.C. 154(b) by 0 days.

(21) Appl. No.: 09/231,205

(22) Filed: Jan. 14, 1999

(51) Int. Cl.[7] ..... B21D 53/88

(52) U.S. Cl. ..... 29/897.2; 29/401.1; 280/781; 296/193; 187/222

(58) Field of Search ..... 29/897.1, 897.2, 29/401.1; 280/781, 785; 296/197, 196, 193; 414/628, 629, 631, 641; 187/222, 237

(56) References Cited

U.S. PATENT DOCUMENTS

| | | | | |
|---|---|---|---|---|
| 3,497,095 | * | 2/1970 | Couberly | 214/674 |
| 3,754,315 | * | 8/1973 | Heitman | 29/401.1 |
| 4,231,144 | * | 11/1980 | Bernacchia, Jr. | 29/401.1 |
| 4,599,780 | * | 7/1986 | Rohrbacher | 29/401.1 |
| 4,654,946 | * | 4/1987 | Phillips | 29/401.1 |
| 4,781,260 | * | 11/1988 | Morita et al. | 280/785 |
| 4,834,424 | * | 5/1989 | Link | 280/785 |

FOREIGN PATENT DOCUMENTS

| | | | | |
|---|---|---|---|---|
| 004316600 | * | 11/1994 | (DE) | 280/785 |

* cited by examiner

*Primary Examiner*—S. Thomas Hughes
*Assistant Examiner*—Jermie E. Cozart
(74) *Attorney, Agent, or Firm*—Clark Hill PLC

(57) ABSTRACT

The method for enhancing the capacity of a rigging truck includes cutting the vehicle body of the rigging truck between a rear end and a lift end to produce a rear cut end and a lift cut end, and attaching a structural insert between the rear cut end and the lift cut end providing an extended vehicle body having an enhanced body length greater than the original body length producing an enhanced rigging truck. The method further includes the addition of metal plating to the vehicle body to strengthen the vehicle body. The method also includes connecting additional counterweights at the rear end of the enhanced rigging truck to provide an increased weight. Vertical support beams and a cross beam are attached on the upper portion of the vehicle body and over the operator seat. A hydraulic cylinder is connected between the cross beam and the mast over the occupant seat to allow tilting of the mast with respect to the rigging truck. A hydraulic cylinder is also connected between the mast and the carriage to allow raising and lowering of the carriage with respect to the mast and the vehicle body.

6 Claims, 3 Drawing Sheets

41
22'
23'
20'
16'
37
12'
26'
28'
C
Y
Z
18'
30
10'
24'
14'
18'

METHOD FOR ENHANCING A FORKLIFT CAPACITY

BACKGROUND OF THE INVENTION

1. Field of the Invention

The invention relates to a method of enhancing an existing forklift or rigging truck to increase lift capacity.

2. Description of the Related Art

Forklifts or rigging trucks are commonly known in the art for allowing the lifting and moving of loads. Prior art rigging trucks include a vehicle connected to a mast which supports a carriage. The mast is pivotally connected to the vehicle and the carriage is telescopingly connected to the mast. The carriage generally comprises fork lift arms and a load support extending generally parallel to the mast. In the prior art, the carriage is chain driven in the telescoping manner, and the carriage is pivoted with respect to the vehicle by hydraulics located at the base of the vehicle.

An improved design has been developed by the same assignee of the invention which includes the tilting hydraulics moved to an upper location on the vehicle and above the occupant to improve lift capacity. Furthermore, the chains of the prior art have been replaced by a hydraulic cylinder to telescope the carriage on the mast. A cage is provided over the occupant to support the tilting hydraulics.

It is constantly desirous to increase lift capacity of rigging trucks. Larger rigging trucks have been used in order to obtain larger lift capacity. However, size and expense requirements limit the available lifting capacity. Therefore, it is desirable to maximize the capacity of existing rigging trucks.

SUMMARY OF THE INVENTION

The invention is a method of enhancing the capacity of a rigging truck. The method includes the step of providing a rigging truck having a vehicle body of a predetermined body length extending between a rear end and a lift end, two sets of wheels supporting the vehicle body separated by a predetermined wheel length, and a mast connected to the lift end and supporting a carriage for lifting loads. The method further includes the steps of cutting the vehicle body of the rigging truck between the rear end and the lift end to produce a rear cut end and a lift cut end, providing a structural insert, and attaching the structural insert between the rear cut end and the lift cut end providing an extended vehicle body having an enhanced body length greater than the predetermined body length producing an enhanced rigging truck.

The invention also includes providing the rigging truck with counterweights of a predetermined weight connected at the rear end, and an operator seat on an upper portion of the rigging truck. The method includes the steps of connecting additional counterweights at the rear end of the enhanced rigging truck to provide an enhanced weight greater than the predetermined weight, attaching a structural cage on the upper portion of the vehicle body and over the operator seat, connecting a hydraulic cylinder between the structural cage and the mast over the occupant seat to allow tilting of the mast with respect to the rigging truck, and connecting a hydraulic cylinder between the mast and the carriage to allow raising and lowering of the carriage with respect to the mast and the vehicle body.

One advantage associated with the invention is the ability to enhance the capabilities and capacity of a rigging truck. Another advantage associated with the inventive method is the ability to utilize existing rigging trucks to create enhanced rigging trucks. Yet another advantage associated with the inventive method is the ability to increase the load capacity of an existing rigging truck from approximately 15,000 pounds to approximately 30,000 pounds.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
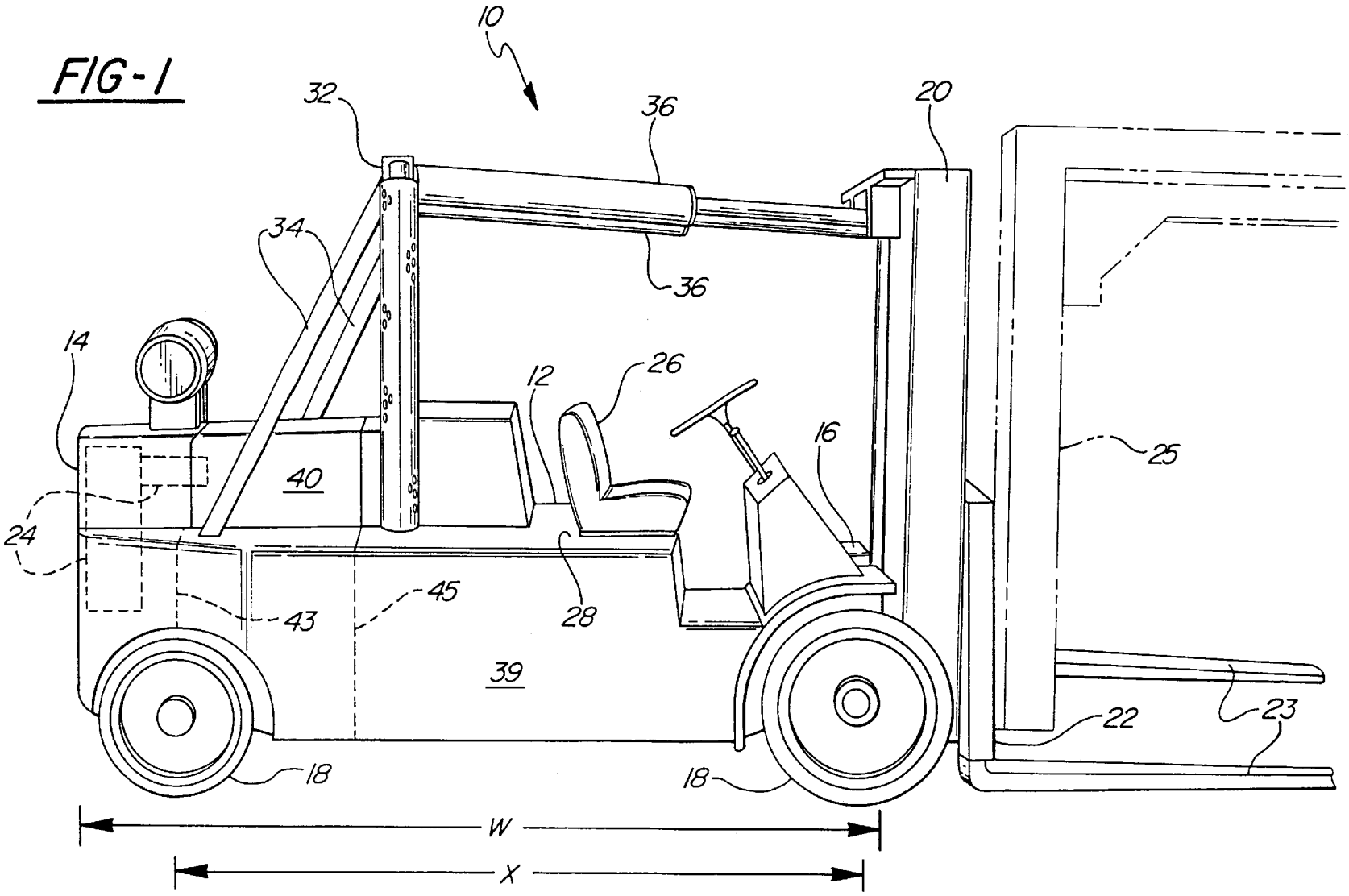
FIG. 1 is a side elevational view of one embodiment of the invention.
Figure 2:
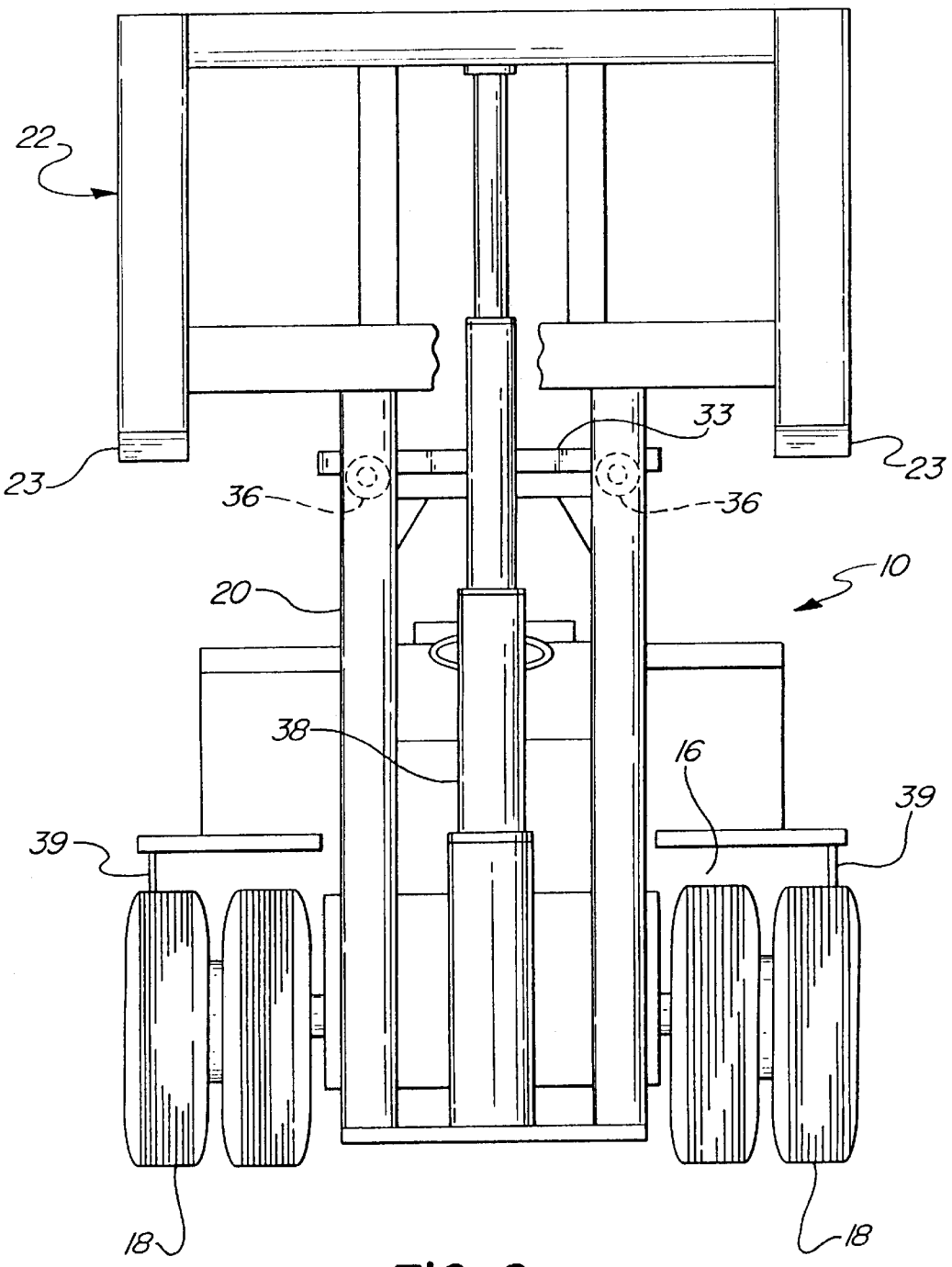
FIG. 2 is a front elevational view of one embodiment of the invention.

An enhanced rigging truck 10 produced according to the method of the invention is shown in FIGS. 1 and 2. The rigging truck 10 includes a vehicle body 12 extending between a rear end 14 and a lift end 16 for an enhanced body length W. The rigging truck 10 also includes two sets of wheels 18 separated by an enhanced distance X. The two sets of wheels 18 support the vehicle body 12. A mast 20 is pivotally connected to the lift end 16 as commonly known in the art, and supports a carriage 22 for lifting loads. The carriage 22 typically includes the fork arms 23. A boom 25 may also be supported on the carriage 22.

Counterweights 24 are attached in the rear end 14 of the vehicle body 12 providing an enhanced weight. The rigging truck 10 includes an operator seat 26 on an upper portion 28 thereof. A structural cage (not shown) may be connected on the upper portion 28 of the vehicle body 12 and includes a pair of vertical support beams 32 extending higher than the operator seat 26 to a cross beam 33. The vertical support beams 32 are located behind or toward the rear end 14 of the vehicle body 12 on either side thereof. A pair of angled supports 34 are connected at the top of the support beams 32 and angled toward the rear end 14 to provide added support. At least one hydraulic cylinder 36 extends between the cross beam 33 and mast 20 to provide tilting of the mast 20 with respect to the vehicle body 12. In the preferred embodiment, two tilting hydraulic cylinders 36 are shown. Furthermore, at least one telescoping hydraulic cylinder 38 is connected between the mast 20 and the carriage 22 to allow the carriage 22 to be raised and lowered.

The vehicle body 12 is further strengthened by the additions of metal plating 39. In the preferred embodiment, a metal plate 39 is fixedly secured to either side of the vehicle body 12. The metal plates 39 are approximately one inch thick and extend along the entire side surfaces of the vehicle body 12, including structural inserts 40, discussed subsequently. Although the metal plates 39 may be secured to vehicle body 12 in any number of ways well known to those skilled in the art, the preferred embodiment includes welding the metal plates 39 to the vehicle body 12.

Figure 3:
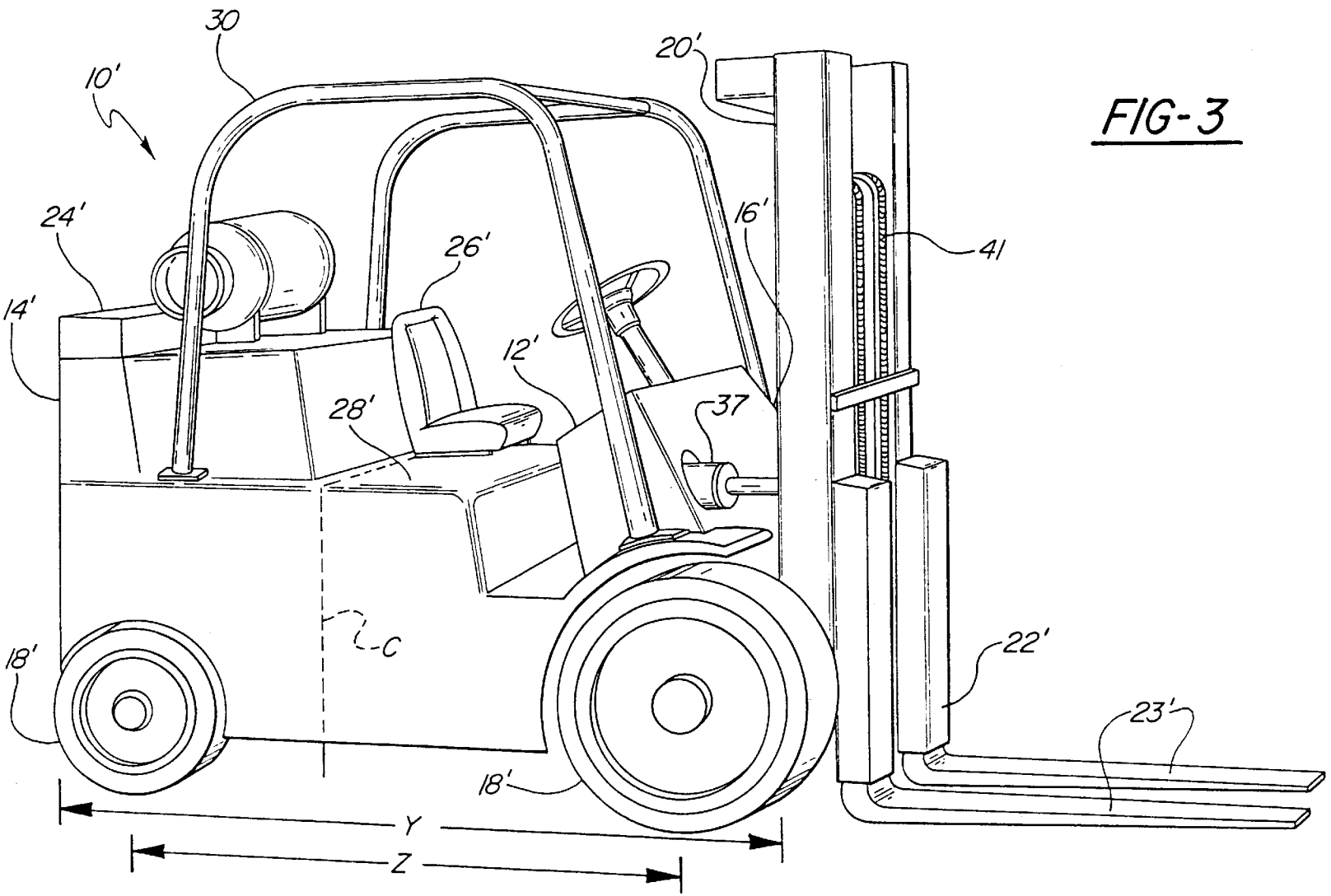
FIG. 3 is a side elevational view of a pre-existing rigging truck.

The invention is a method of enhancing the capacity of an existing rigging truck 10' (shown in FIG. 3) to produce the enhanced rigging truck 10. Like parts are shown in primed reference numerals between the Figures. The existing rigging truck 10' includes a vehicle body 12' extending between a rear end 14' and a lift end 16' for a predetermined body length Y. The rigging truck 10' also includes two sets of wheels 18' separated by a predetermined wheel distance Z supporting the vehicle body 12'. A mast 20' is pivotally connected to the lift end 16' and supports a carriage 22' for lifting loads. Counterweights 24' may be attached in the rear end 14' of the vehicle body 12' providing a predetermined weight. The rigging truck 10' includes an operator seat 26' on an upper portion 28' thereof. A tilting hydraulic cylinder 37 is connected between the lift end 16' and the mast 20' at a location below the operator seat 26' and adjacent the front wheels 18'. A chain drive 41 is connected along the mast 20' and to the carriage 22' to raise and lower the carriage 22'.

The method of enhancing the existing rigging truck 10' to form the enhanced rigging truck 10 includes the step of cutting (shown in phantom at C) the vehicle body 12' of the rigging truck 10' between the rear end 14' and the lift end 16' to produce a rear cut end 43 and lift cut end 45, respectively. The location of the cut C may vary, and it is merely desirable to allow extension of the rear end 14' of the vehicle. The frame (not shown) of the existing rigging truck 10' is also cut along the cut line C.

A structural insert 40 (shown in phantom in FIG. 1) is provided to extend the length of the vehicle body 12'. The structural insert 40 is attached between the rear cut end 43 and the lift cut end 45 providing the extended vehicle body 12 having the enhanced body length W greater than the predetermined body length Y producing the enhanced rigging truck 10. In addition, the frame is also lengthened to the enhanced wheel base X.

The metal plates 39 are then secured to the sides of the vehicle body 12'. The metal plates 39 are welded thereto and cover at least a portion of the sides of the vehicle body 12' and all of the structural inserts 40.

Furthermore, additional counterweights are connected at the rear end 14 of the enhanced rigging truck 10 to provide the enhanced weight greater than the predetermined weight.

In one embodiment, a structural cage may replace a cage 30. In the preferred embodiment, the vertical supports 34 and the cross beam 33 are attached on the upper portion of the vehicle body 12 and over the operator seat 26. The hydraulic cylinder 36 is connected between the cross beam 33 and the mast 20 over the occupant seat to allow tilting of the mast 20 with respect to the rigging truck 10. The tilting hydraulic cylinder 37 is removed from the existing rigging truck 10'. The telescoping hydraulic cylinder 38 is connected between the mast 20 and the carriage 22 to allow raising and lowering of the carriage with respect to the mast 20 and vehicle body 12.

Additionally, the wheels 18 are attached on the enhanced rigging truck 10 at a distance greater than the predetermined wheel length (X>Z). In other words, the rear axle of the rear wheels 18 is moved back to extend the wheel length. More specifically, in the preferred embodiment, the wheels 18 are moved the same distance as the width of the insert 40.

For example, in one embodiment, the existing rigging truck 10' had a predetermined wheel length of eighty-nine inches. An insert 40 of twenty-four inches is added to the vehicle body 12' to produce the enhanced body length W, i.e., the enhanced body length W is two feet longer than the predetermined body length Y. The wheels 18 are also moved two feet further out, i.e., the predetermined wheel Z was extended two feet to the enhanced wheel distance X. Different dimensions may be used depending on the original rigging truck 10 and the desired increase in capacity. In this particular embodiment, and by applying the inventive method, the rigging truck 10 increased its capacity from 15,000 pounds to 30,000 pounds at a twenty-four inch load center without significantly increasing the size of the rigging truck 10 and overall materials, and therefore cost.

The structural added modifications based on the method may be attached by welding, or other means as known in the art. It is to be appreciated that the method may be applied to different sizes and types of rigging trucks to produce the advantages discussed herein.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

What is claimed is:

1. A method of enhancing the capacity of a rigging truck, the method including the steps of:

providing a rigging truck having a vehicle body of a predetermined body length extending between a rear end and a lift end, two sets of wheels supporting the vehicle body and separated by a predetermined wheel length, counterweights of a predetermined weight connected at the rear end, and a mast connected to the lift end and supporting a carriage for lifting loads;

cutting the vehicle body of the rigging truck between the rear end and the lift end to produce a rear cut end and a lift cut end;

providing a structural insert;

attaching the structural insert between the rear cut end and the lift cut end providing an extended vehicle body having an enhanced body length greater than the predetermined body length producing an enhanced rigging truck;

securing metal plating to the vehicle body of the rigging truck between the rear end and the lift end to strengthen the vehicle body;

connecting additional counterweights at the rear end adjacent the counterweights and axially disposed from the structural insert of the enhanced rigging truck to provide an enhanced weight greater than the predetermined weight; and attaching a structural cage on an upper portion of the vehicle body and over an operator seat provided thereby.

2. A method as set forth in claim 1 further including connecting a hydraulic cylinder between the structural cage and the mast over the occupant seat to allow tilting of the mast with respect to the rigging truck.

3. A method as set forth in claim 2 further including connecting a hydraulic cylinder between the mast and the carriage to allow raising and lowering of the carriage with respect to the mast and the vehicle body.

4. A method as set forth in claim 3 further including providing the rigging truck with a tilt cylinder connected between the vehicle body and the mast below the operator seat, and removing the tilt cylinder.

5. A method of enhancing the capacity of a rigging truck, the method including the steps of:

providing a rigging truck having a vehicle body of a predetermined body length extending between a rear end and a lift end, two sets of wheels supporting the vehicle body and separated by a predetermined wheel length, a mast connected to the lift end and supporting a carriage for lifting loads, counterweights of a predetermined weight connected at the rear end, and an operator seat on an upper portion of the rigging truck;

cutting the vehicle body of the rigging truck between the rear end and the lift end to produce a rear cut end and a lift cut end;

providing a structural insert;

attaching the structural insert between the rear cut end and the lift cut end providing an extended vehicle body having an enhanced body length greater than the predetermined body length producing an enhanced rigging truck;

connecting additional counterweights at the rear end of the enhanced rigging truck to provide an enhanced weight greater than the predetermined weight;

attaching vertical support beams and a cross beam on the upper portion of the vehicle body and over the operator seat;

connecting a hydraulic cylinder between the cross beam and the mast over the occupant seat to allow tilting of the mast with respect to the rigging truck; and connecting a hydraulic cylinder between the mast and the carriage to allow raising and lowering of the carriage with respect to the mast and the vehicle body.

6. A method as set forth in claim 5 further including securing metal plating to the entire enhanced length of the vehicle body of the rigging truck between the rear end and the lift end to strengthen the vehicle body.

* * * * *